US008784173B2

(12) United States Patent
Parham

(10) Patent No.: US 8,784,173 B2
(45) Date of Patent: Jul. 22, 2014

(54) MULTI-WIN POKER GAME

(76) Inventor: Tyler T Parham, Reno, NV (US)

( * ) Notice: Subject to any disclaimer, the term of this patent is extended or adjusted under 35 U.S.C. 154(b) by 245 days.

(21) Appl. No.: 12/876,105

(22) Filed: Sep. 3, 2010

(65) Prior Publication Data

US 2011/0117980 A1 May 19, 2011

Related U.S. Application Data

(60) Provisional application No. 61/240,169, filed on Sep. 4, 2009, provisional application No. 61/243,505, filed on Sep. 17, 2009, provisional application No. 61/304,872, filed on Feb. 16, 2010.

(51) Int. Cl.
*A63F 1/00* (2006.01)

(52) U.S. Cl.
USPC ..... 463/13; 463/16; 463/17; 463/18; 463/19; 463/20; 463/25; 273/138.1; 273/139; 273/274; 273/292; 273/309

(58) Field of Classification Search
USPC ..... 463/16–23, 11–13, 25–27; 273/274, 273/292, 309, 138.1, 139
See application file for complete search history.

(56) References Cited

U.S. PATENT DOCUMENTS

| | | | | |
|---|---|---|---|---|
| 6,098,985 | A * | 8/2000 | Moody | 273/292 |
| 6,270,405 | B1 * | 8/2001 | Ferguson | 463/13 |
| 6,435,509 | B2 * | 8/2002 | Wichinsky et al. | 273/292 |
| 6,471,587 | B1 * | 10/2002 | Wood et al. | 463/13 |
| 2007/0060236 | A1 | 3/2007 | Dodge | |
| 2007/0126180 | A1 | 6/2007 | Dodge | |

* cited by examiner

*Primary Examiner* — Sunit Pandya
(74) *Attorney, Agent, or Firm* — NWAMU, P.C.; Fidel Nwamu

(57) ABSTRACT

An electronic video poker machine configured to allow play of multiple hands of video poker. The electronic video poker machine comprises at least one display device, at least one input device, and at least one computer configured to display at least a first hand and a second hand of at least three cards all face up, wherein a computer uses selected hold cards of the first hand to select the best poker hand for a second and subsequent poker hands. If the hold cards from the first hand make the best possible poker hands, they are used to replace one or more selected cards of the second and subsequent hands.

19 Claims, 18 Drawing Sheets

TABLE 1

JACKS OR BETTER DRAW POKER

| | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

MULTI-WIN POKER GAME

CLAIM OF PRIORITY

The present application claims priority from U.S. Provisional Patent Application Ser. No. 61/240,169 entitled "Multi-Hand Auto-Select Power Poker Game," filed on Sep. 4, 2009; U.S. Provisional Patent Application Ser. No. 61/243,505 entitled "Multi-Hand Auto-Select Power Poker Game" filed Sep. 17, 2009; and U.S. Provisional Patent Application Ser. No. 61/304,872 entitled "Multi-Win Poker Game" filed Feb. 16, 2010, all of which are hereby incorporated by reference as if fully set forth in the present specification.

BACKGROUND OF THE INVENTION

Particular embodiments generally relate to poker gaming systems and methods and in particular to a multiple poker hand electronic video poker game.

The entertainment value of multiple hand poker games continues to remain high. Players are not limited to a single poker hand but can enjoy multiple hand poker games. Players continue to seek additional entertainment opportunities and efficiencies as well as a higher hit frequency for each game.

BRIEF SUMMARY OF THE INVENTION

Particular embodiments involve an electronic video poker card game in which the player plays multiple hands of cards.

The player selects the number of poker hands to be played, which includes at least two hands of poker. The gaming device may also be programmed with a predetermined number of games for the player to play. The player then places a wager to play at least two hands of poker. The player may be able to place a separate wager on each of the separate hands of poker to be played by the player or the gaming device may be programmed for the wager placed by the player to be applied to each of the poker games played by the player in any traditional manner.

After the player places the proper wager amount and initiates play of the game, one hand of five cards is dealt by the electronic video poker card game all face up and five cards backs may be displayed for each of the additional poker hands being played. The player may select one or more of the face up cards from the first hand as cards to be held or the player may select not to hold any cards. After the player decides to either hold or not to hold the cards, the player selects draw.

The one or more (additional poker hands) selected to be played are each dealt from a separate deck (52 cards) of cards face up after the draw of the first hand is initialized and replacement cards for the non-selected cards are dealt into the first hand.

In one embodiment, before the cards are dealt for each of the additional hands, the one or more cards that were selected to be held from the first hand are removed from each of the decks of card used for the one or more additional poker hands. In one or more embodiments, all the cards dealt for the first hand which are held or not held for the first hand are removed from each of the decks of cards used for the one or more additional poker hands being played by the player.

Each of the additional poker hands receive a new full hand of cards (e.g., five cards in a five card draw poker game). The one or more cards that were selected to be held from the first hand are then used by the game's auto-select feature for each of the remaining hands to replace existing cards.

The cards selected to be held in the first hand may be used in the additional poker hands to make each of the remaining hands a better poker hand. After the draw of the first hand, if one or more of the cards that were held from the first hand are not needed in order to improve the additional poker hands, they may not be used. After the draw of the first hand, if one or more of the cards that were held from the first hand are needed in order to improve the additional poker hands, they may be used.

Preferably, the one or more cards selected to be held from the first hand may only be used in the same positions in the additional hands as dealt in the first hand in order to improve the outcome of the additional poker hands. In one embodiment, the one or more cards selected to be held in the first hand are duplicated into the additional poker hands whether the cards make a better poker hand or not.

When the player decides not to hold any cards dealt from the first poker hand, all cards that are then dealt to the player for the first hand may not be used and the player only receives a pay out from a winning outcome on the deal of the additional poker hands. The player is then paid for any winning hands based on the player's wager and at least one predefined pay table according to the rules defined for the particular card game being played.

Preferably, at least two pay tables are used, one for the first poker hand and one for the additional poker hands. Any type of poker game may be played using particular embodiments, such as 3 card, 4 card, 5 card, 6 card, 7 card, to n card games. Also, particular embodiments can also be applied to any style of poker game such as, for example including but not limited to draw poker. Moreover, cards are not drawn for the one or more additional poker hands. Only the one or more cards selected to be held in the first hand may be used with the card in the additional poker hands.

In one embodiment, a game configuration parameter may be set, for example, as TRUE by the gaming establishment or vendor prior to game play in order for the game to always use the hold cards of the first hand for the one or more additional hands during game play irrespective of how it affects the game results for the one or more additional hands.

Conversely, the game configuration parameter may be set, for example, as FALSE by the gaming establishment or vendor prior to game play in order for the game to only use the hold cards of the first hand for the one or more additional hands if the use of said first hand hold cards causes each of the one or more additional hands to be a better poker hand based on the rules of the particular card game being played.

The method of the present invention may also be used in a multi-game spinning reel game where symbols, indicia, card, etc are used as further described below.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

A further understanding of the nature and the advantages of particular embodiments disclosed herein may be realized by reference of the remaining portions of the specification and the attached drawings.

BRIEF DESCRIPTION OF THE DRAWINGS

The components in the figures are not necessarily to scale, emphasis instead being placed upon illustrating the principles of particular embodiments. In the figures, like reference numerals designate corresponding parts throughout the different views.

Table 1 shows a suitable pay table that is used by the game when playing a basic jacks or Better poker format.

Figure 11:
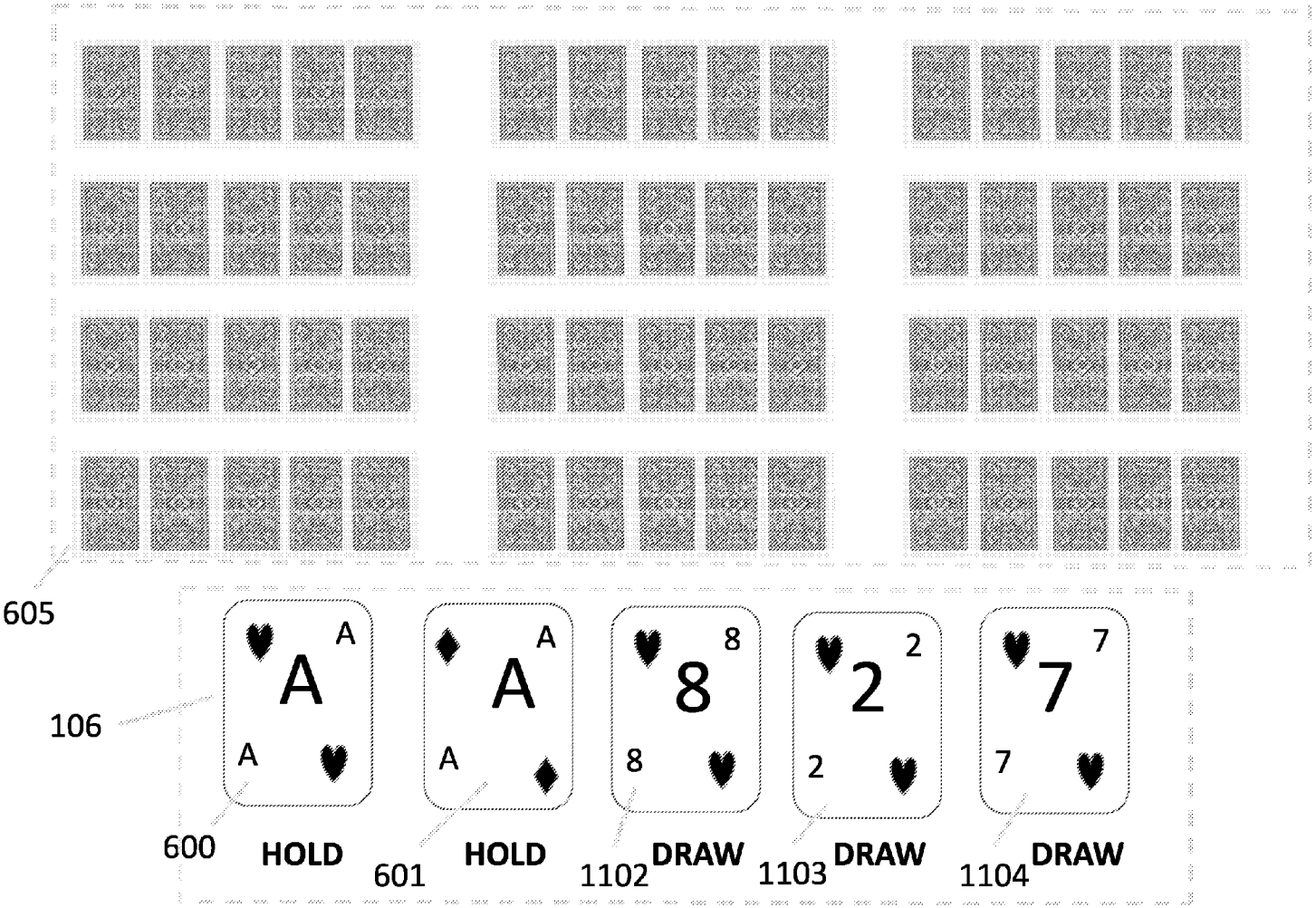

FIG. 11 illustrates an additional embodiment wherein first hand is displayed face up wherein player selects hold cards while card backs are also displayed as place holders for the additional hands.

Figure 12:
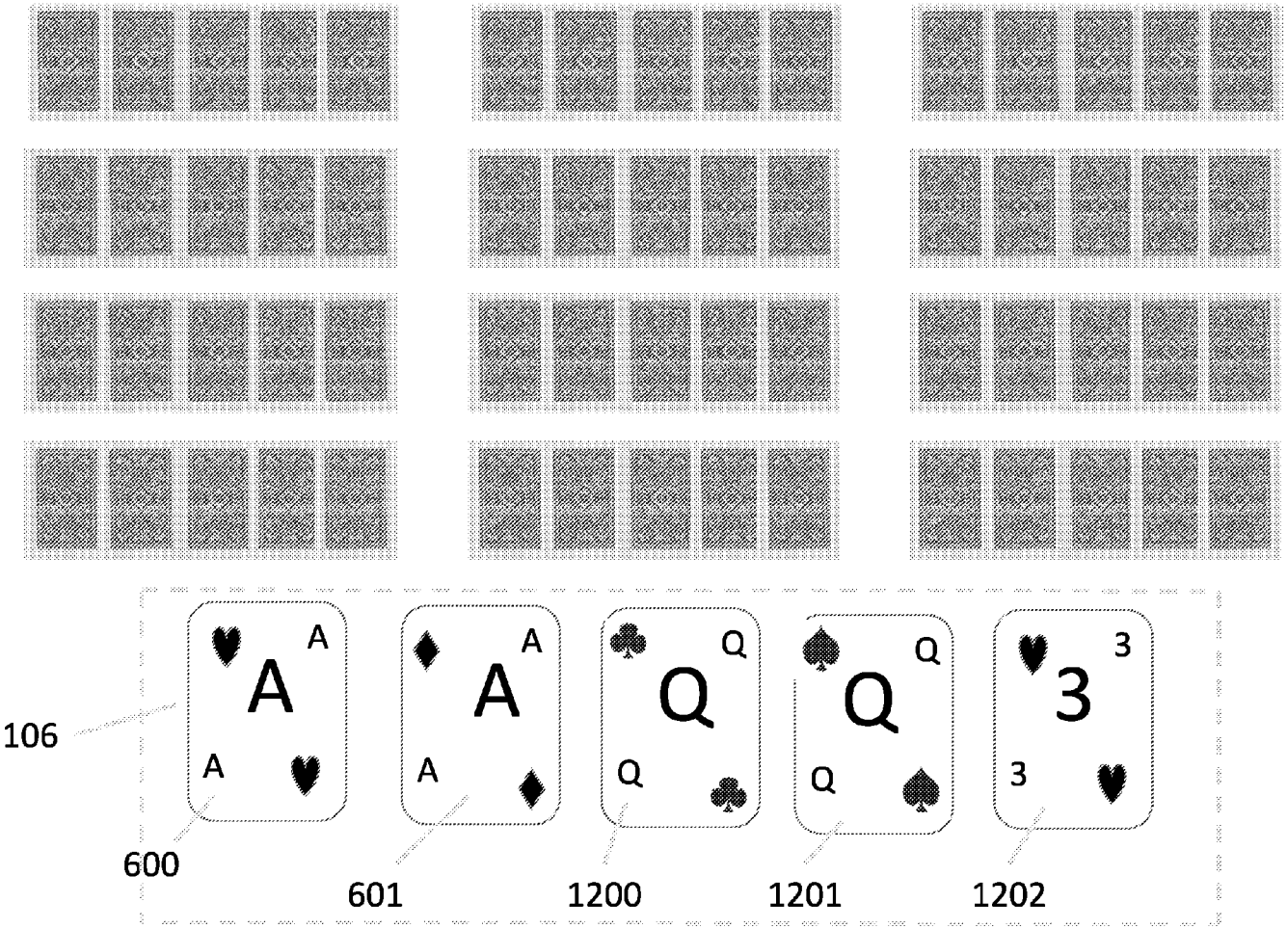

FIG. 12 illustrates the draw for first hand for the additional embodiment wherein the hold cards remain and draw cards are replaced, additionally all the first hand cards are removed from card decks used for the additional hands.

Figure 13:
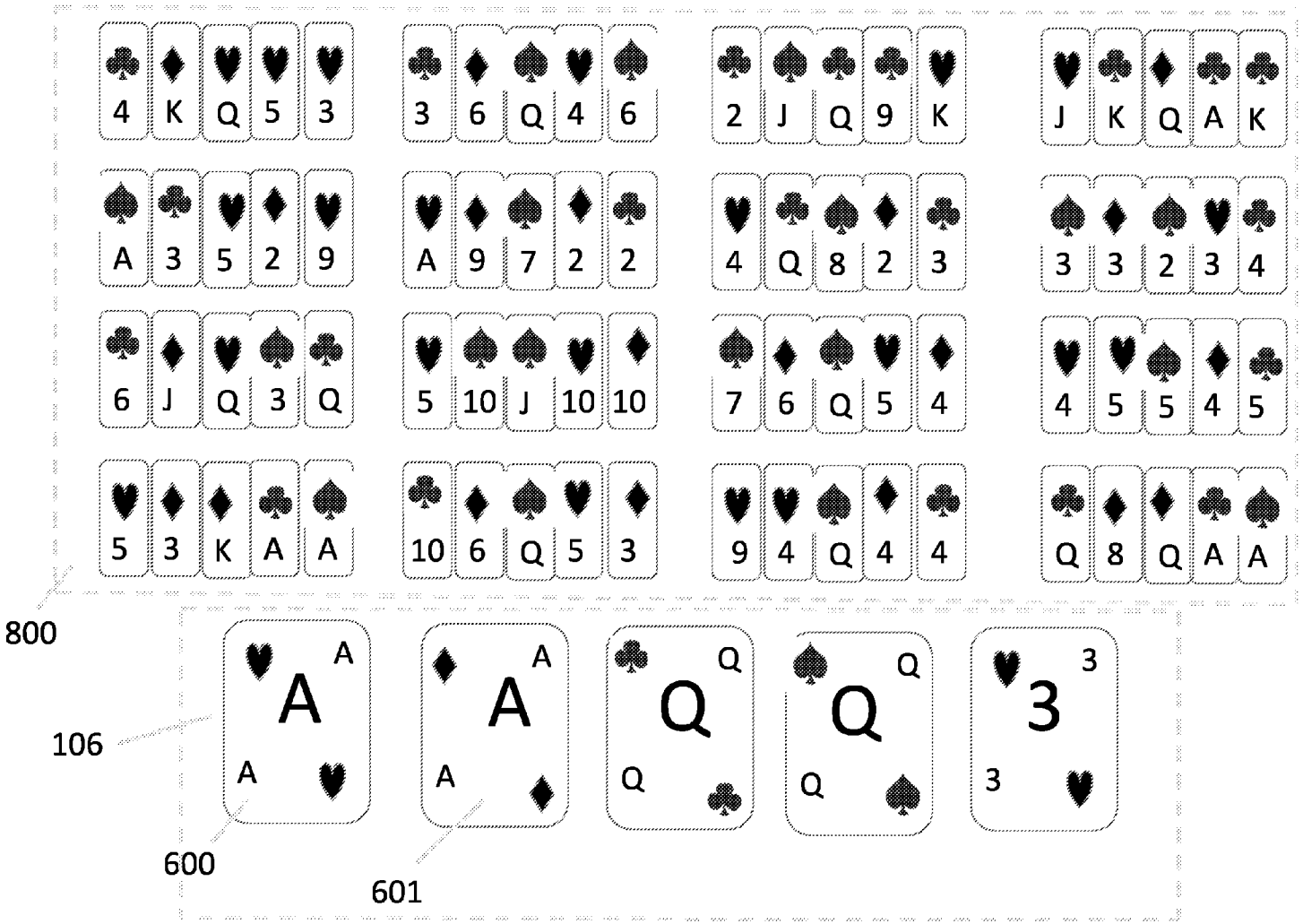

FIG. 13 illustrates additional hands 2 thru N displayed after dealt to player for the additional embodiment.

Figure 14:
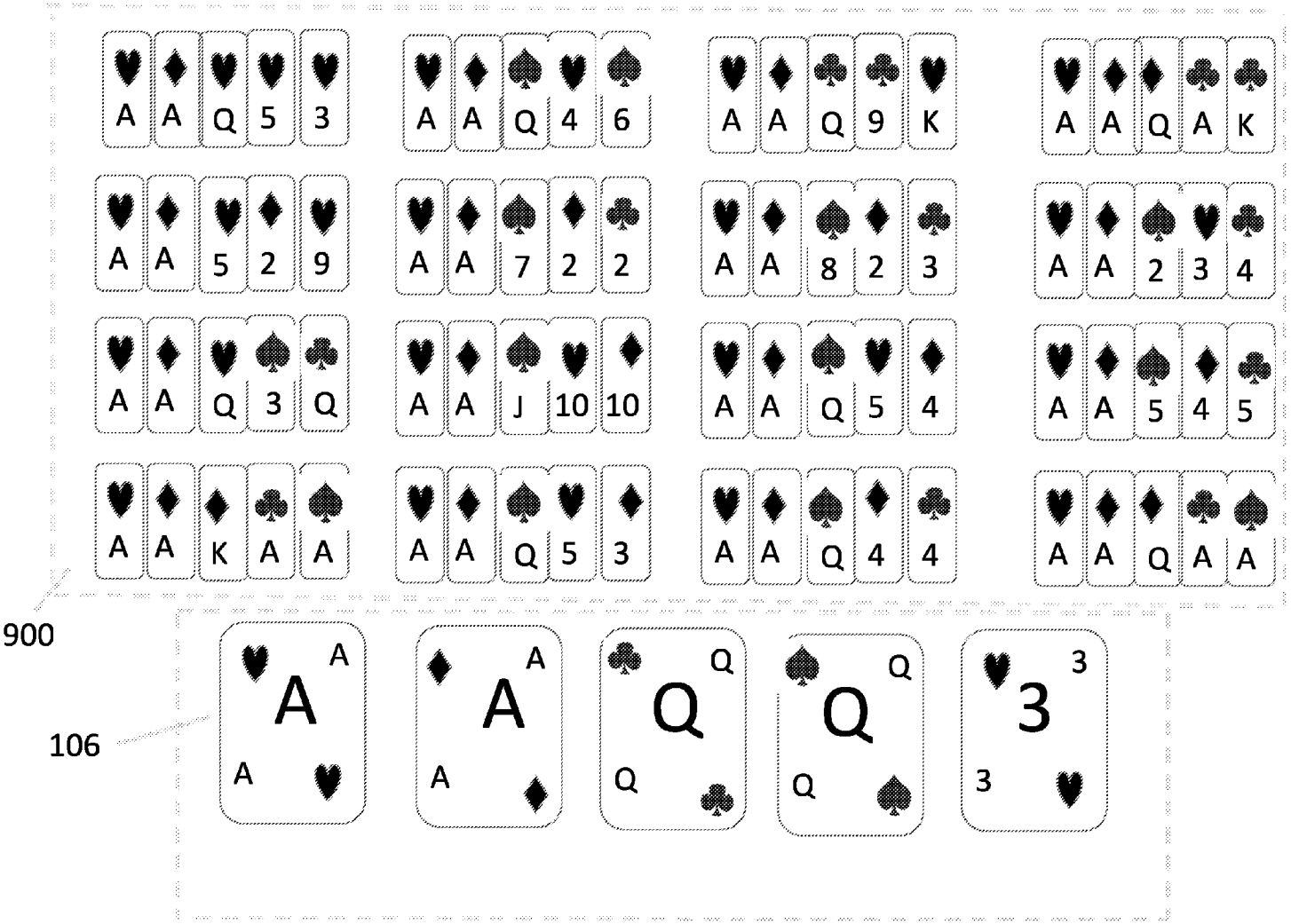

FIG. 14 illustrates the additional embodiment wherein the use of first hand hold cards replacing cards in each additional hand based on the position of the hold cards from the first hand.

Figure 15:
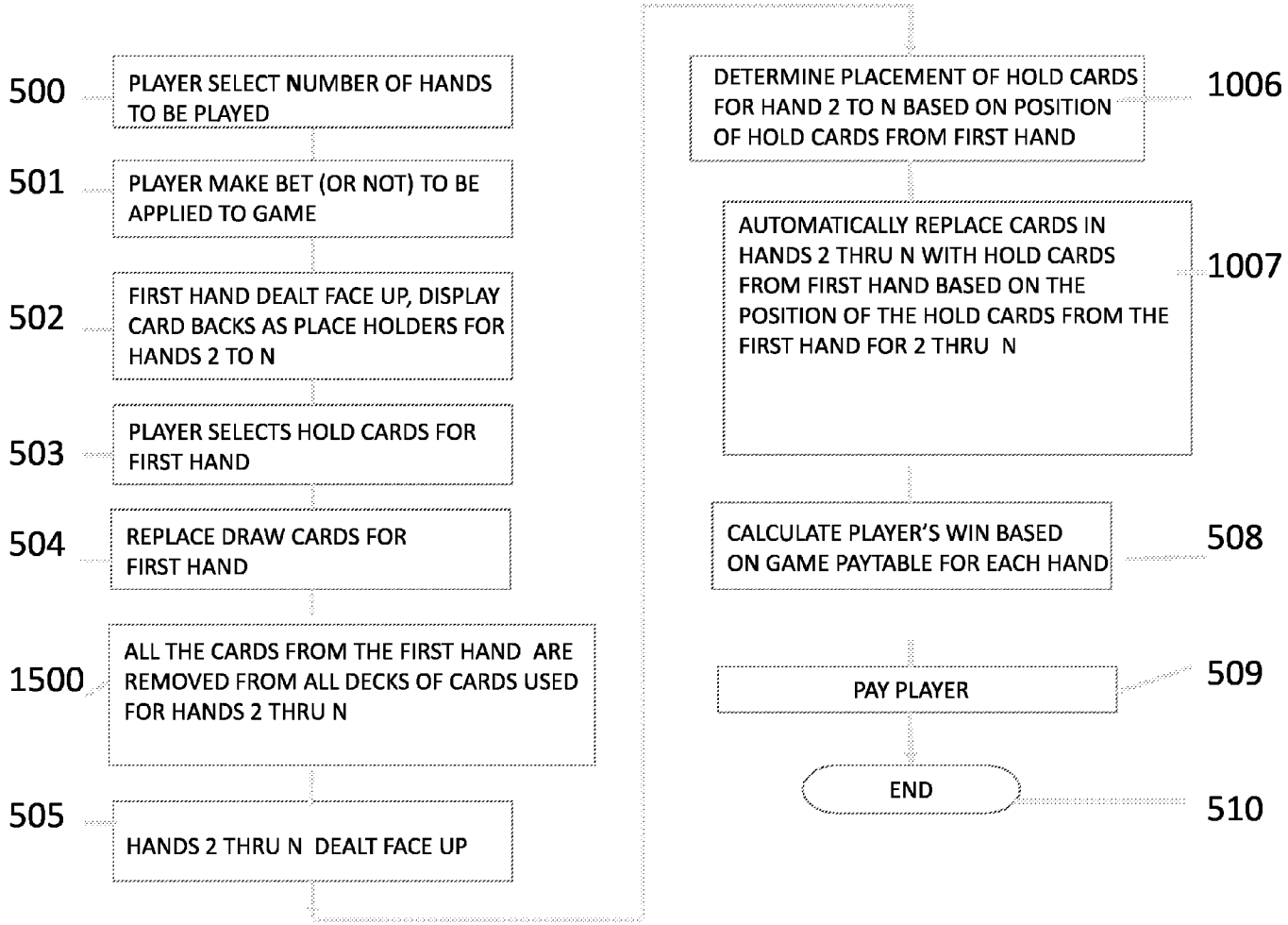

FIG. 15 is a flow chart of the additional embodiment of the game.

Figure 16:
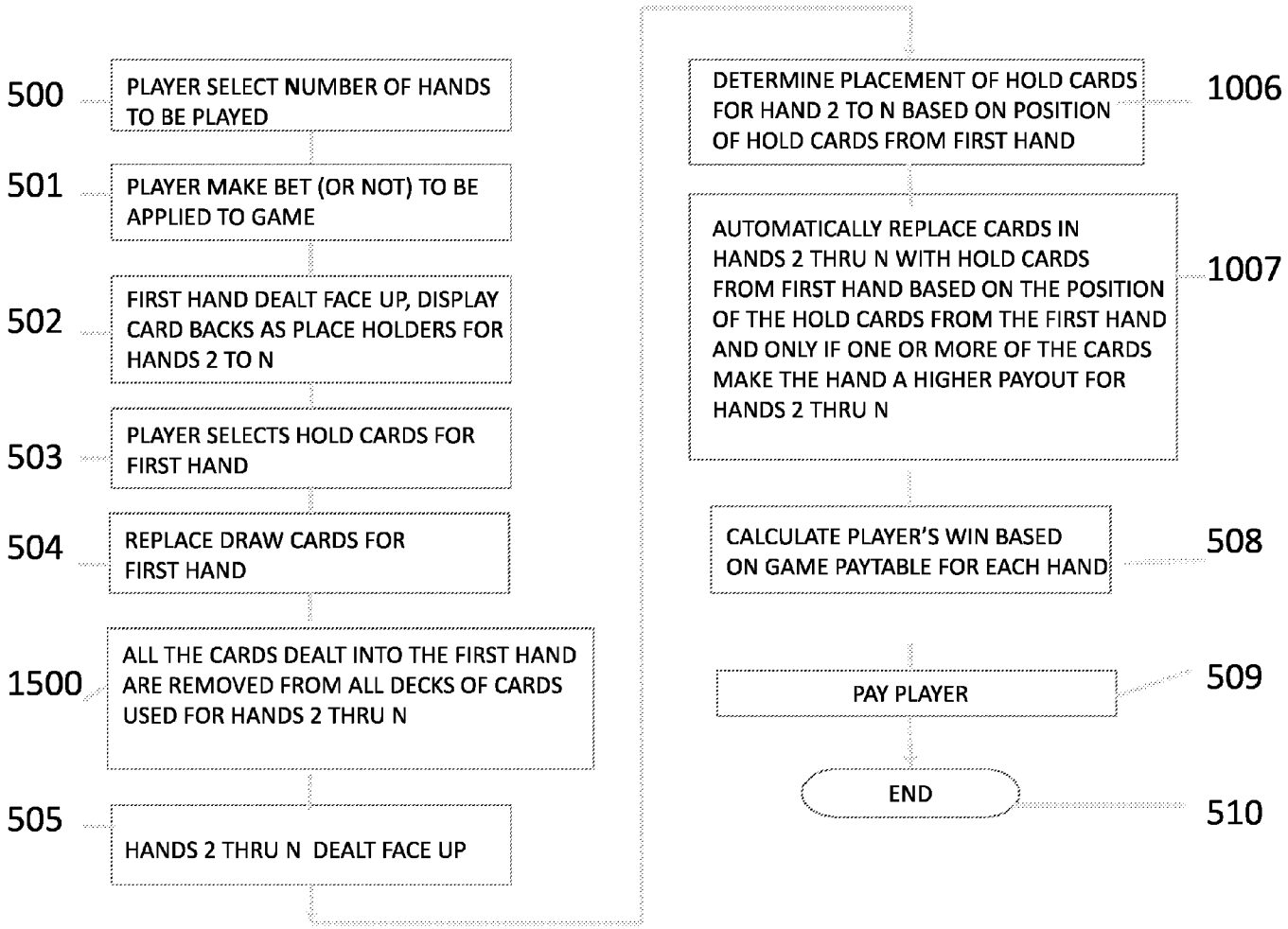

FIG. 16 is a flow chart of an additional embodiment of the game.

Figure 17:
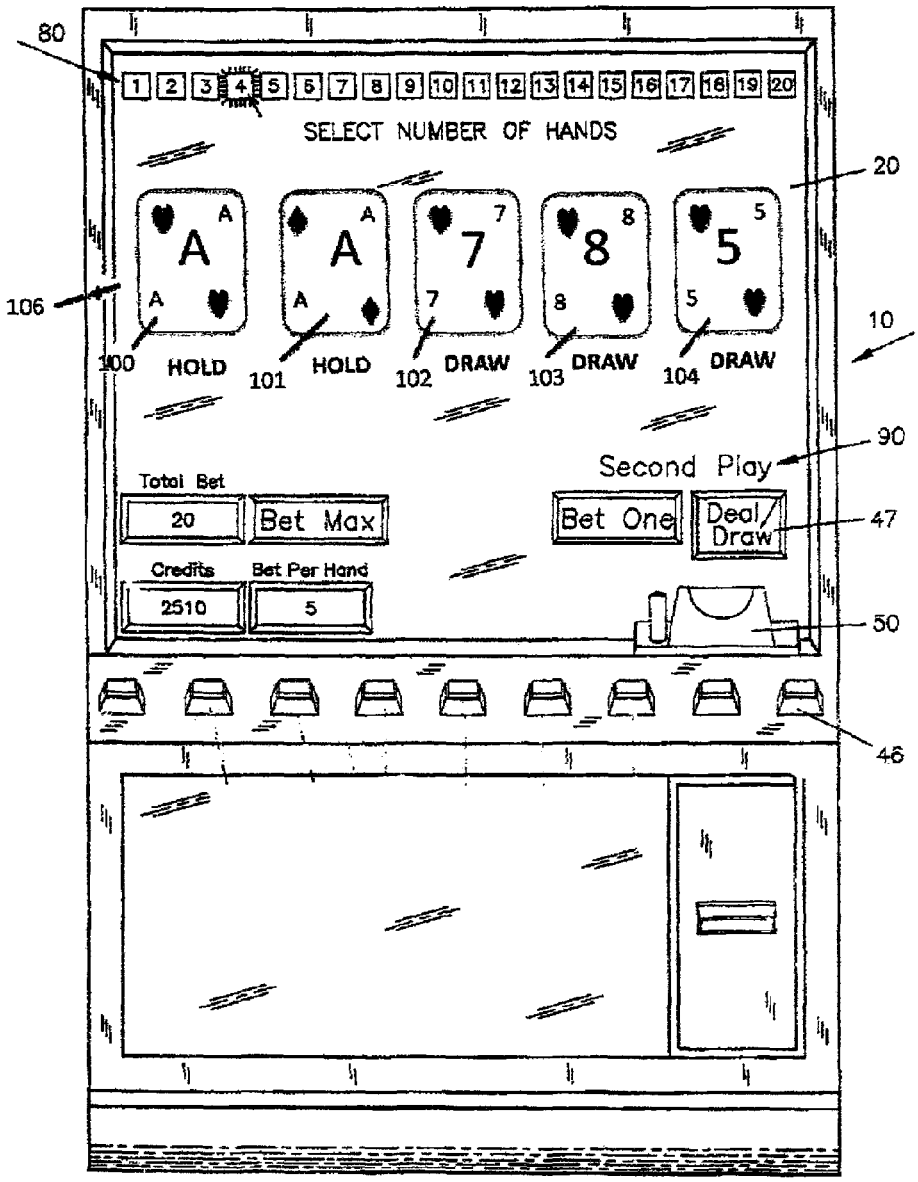

FIG. 17 is an electronic vieo game system according to an exemplary embodiment of the present invention.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Particular embodiments provide an electronic video poker card game in which the player plays multiple hands of cards. An auto-select feature is provided to create additional entertainment and more opportunities to win.

The player selects the number of poker hands to be played, which includes at least 2 hands of poker. The player then makes a wager that is applied to each of the hands dealt to the player that become separate wagers on each of the separate hands of poker to be played by the player.

Figure 1:
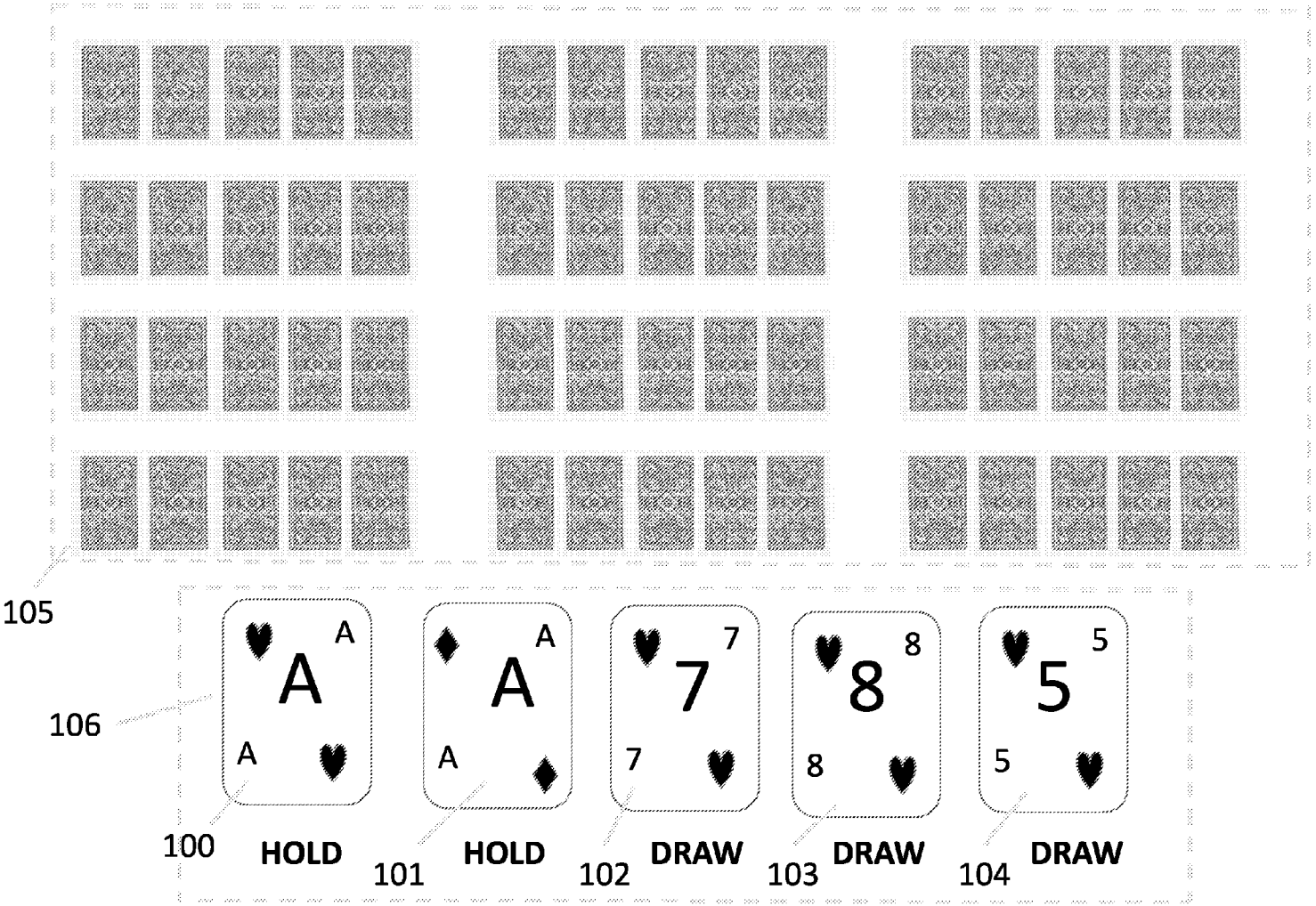
FIG. 1 illustrates an embodiment wherein a first hand is displayed face up wherein a player selects hold cards while card backs are also displayed as place holders for additional hands.

Turning now to FIG. 1, one hand 106 of five cards is dealt by the electronic video poker card game all face up. The player may select one or more of the face up cards from the first hand as cards to be held or the player may select not to hold any cards.

For example, in the embodiment illustrated by FIG. 1, a first hand 106 includes card 100 and card 101, which are selected by the player as hold cards. Card 102, card 103, and card 104 are then considered draw cards to be replaced by the game with new cards. In the example of FIG. 1, 17 poker hands are selected to be played by the player and card backs 105 are displayed as place holders where additional cards will be dealt to form poker hands 2 thru 17. It should be recognized that any number of poker hands may be selected to be played by the player such that the game supports at least two poker hands that may also be referred to as hands 2 through N, where N is the total number of poker hands selected to be played by the player. For the purposes of example, FIGS. 1, 2, 3 and 4 use 17 poker hands played by the player.

Figure 2:
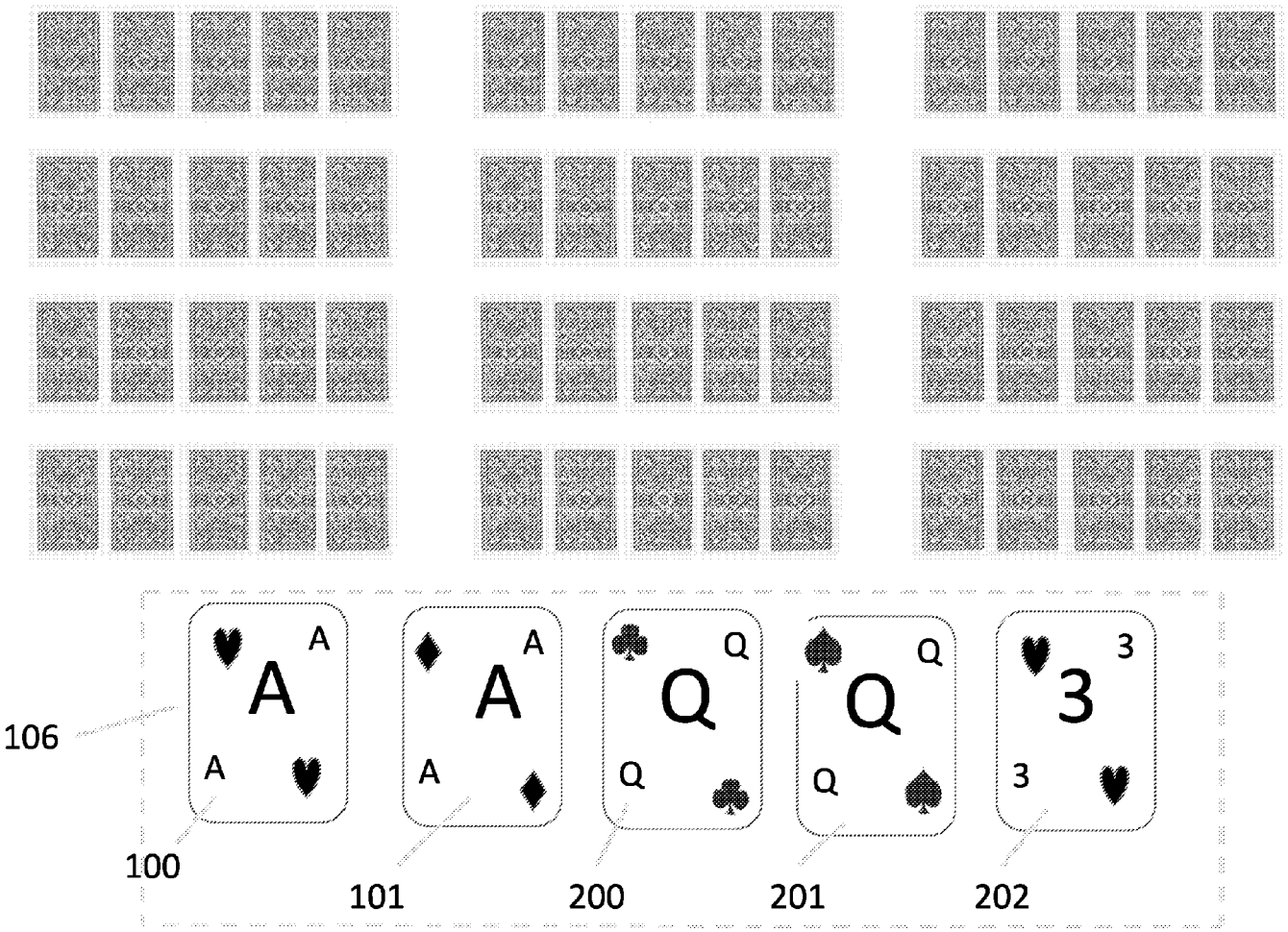
FIG. 2 illustrates draw for the first hand wherein hold cards remain and draw cards are replaced according to one embodiment.

Now turning to FIG. 2, the game has drawn new cards to replace the cards 102, 103 and 104 in first hand 106 with new cards 200, 201 and 202. The cards 100 and 101 remain in first hand 106 and are considered the hold cards that used by the game for hands 2 through N as described below.

Figure 3:
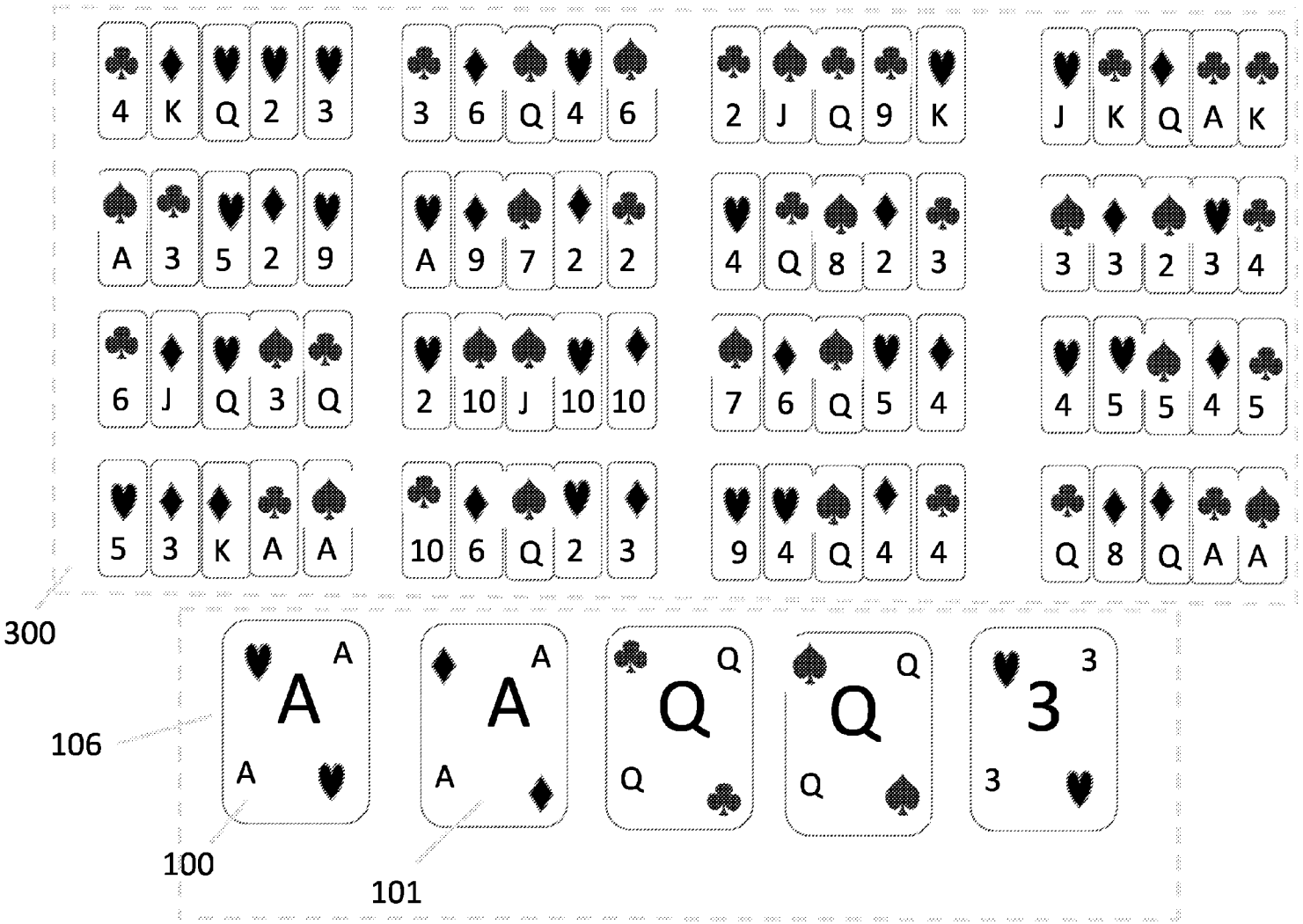
FIG. 3 illustrates additional hands displayed after the cards are dealt to player according to one embodiment.

Now turning to FIG. 3, the 2 through N poker hands, which in this example are 2 through 17 poker hands 300, selected to be played are dealt face up after the draw of the first hand 106 is initialized and replacement cards for the non-selected cards are dealt into the first hand 106. All cards for the full hand are dealt for each hand. That is, the hold cards are not placed in a position for the hand yet. In FIG. 1, the one or more cards that are selected from the first hand 106 for holding namely card 100 and card 101 are then used by the game's auto-select feature and are inserted into poker hands 300, 2 through 17, if applicable.

Figure 4:
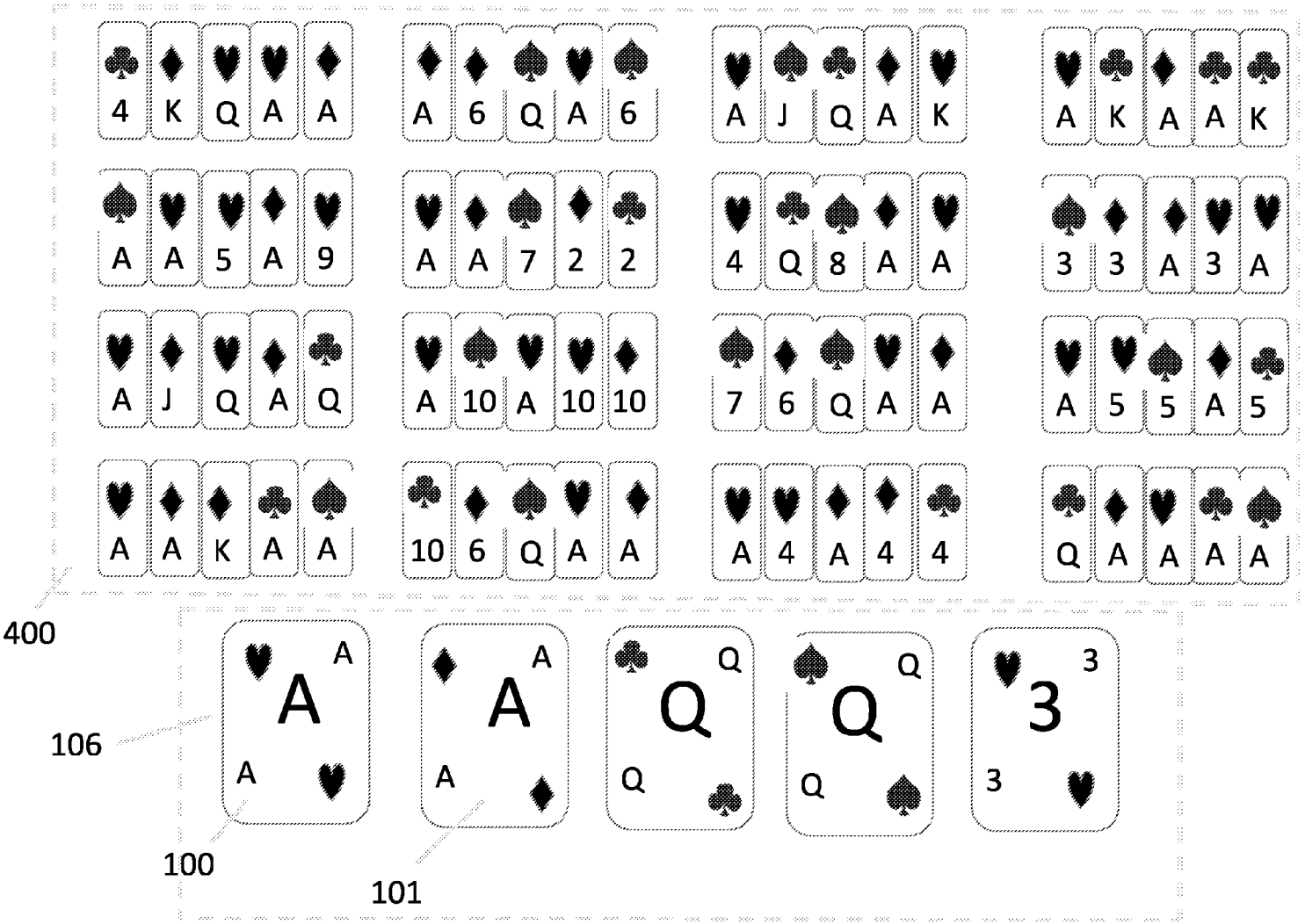
FIG. 4 illustrates the use of the first hand hold cards replacing cards in each additional hand to form a better hand according to one embodiment.

In the embodiment of FIG. 4 the hold cards 100 and 101 are used in the additional poker hands 400 to make each one of the additional poker hands 400 a better poker hand. Cards 100 and 101 are used to replace any card in any of the additional poker hands 400 to make a better poker hand.

A better poker hand is one that has a higher ranking with the hold cards than without. The ranking can be based on standard poker hand rankings such as a "Royal Flush" being higher than a "Four of a Kind" or by using a pay table or other predetermined techniques.

In the embodiment illustrated in FIG. 4, there are two hold cards, card 100 and card 101, that are used to auto-select the cards to be replaced in each of the additional poker hands 400 to make each one of the additional poker hands 400 a better poker hand.

After the draw of the first hand 106, if one or more of the hold cards 100 and 101, from the first hand 106 are not needed in order to improve a particular poker hand in any of the additional poker hands 400, then the hold cards 100 and 101 are not used for that particular poker hand. The one or more hold cards, card 100 and card 101, from the first hand 106 may replace any card in any position of the additional poker hands 400 in order to improve the outcome of the additional poker hands 400.

In one embodiment, the player selects deal and a first hand of five cards is dealt. After the player select to hold none, one or more of the cards to be held the player selects draw. The draw is only use for the first hand. In this embodiment, the draw for the first hand is used as the deal for the additional hands. So in essences there is draw for the additional hands 400. After the draw is selected for the first hand, five cards are dealt for each additional hand and then the auto-selection is automatically performed. Thus, a user is not drawing for additional cards. Also, because hold cards are only used to replace cards when a better poker hand is made, the same hold cards or any hold cards may not be present in all hands.

Figure 5:
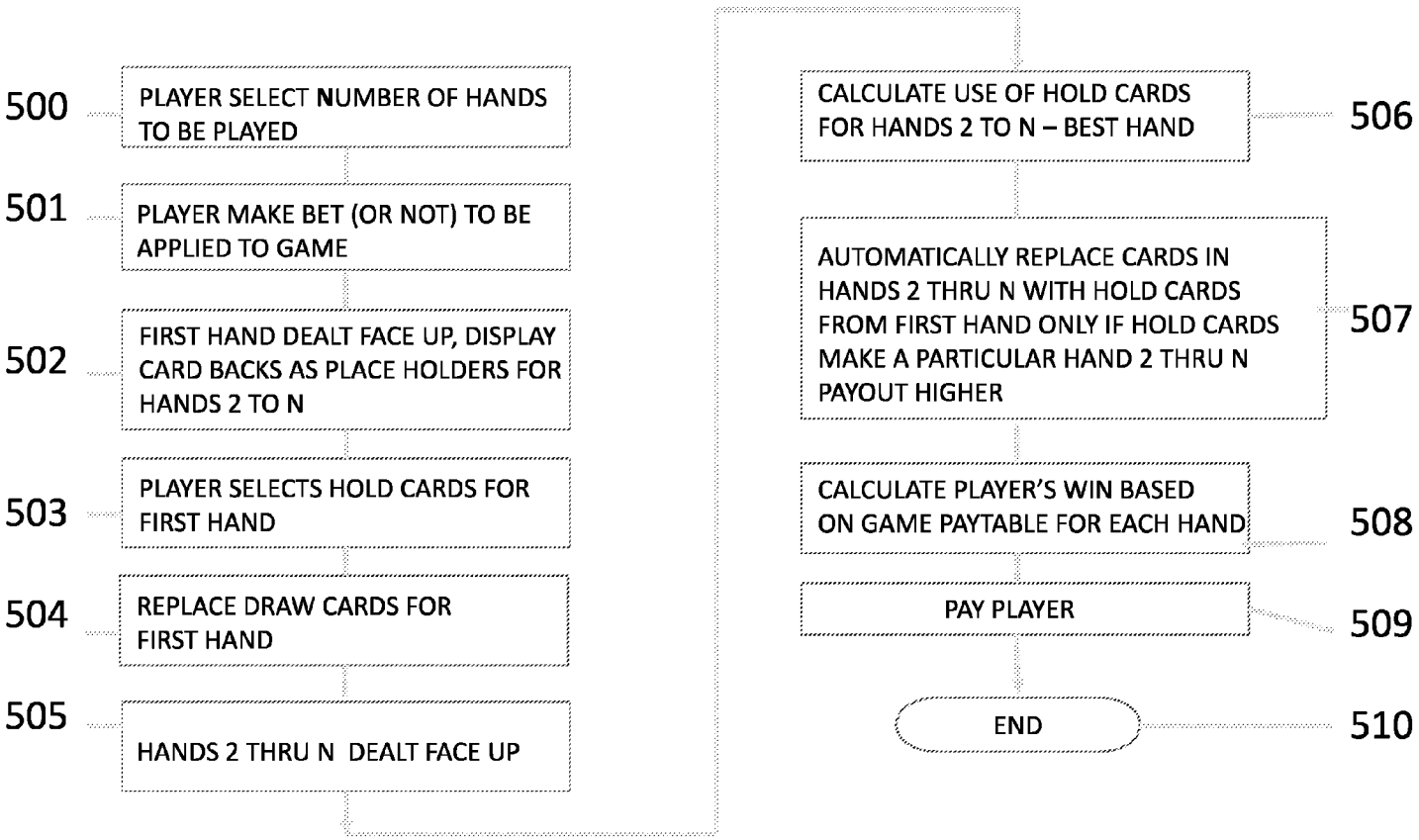
FIG. 5 is a flow chart of one embodiment of the game.

FIG. 5 depicts a simplified flowchart for providing a multi-hand poker game according to one embodiment. Step 500 receives a selection from the player of a number of hands to be played, which can be at least 2 poker hands.

Step 501 receives a bet from the player to play two or more hands of poker. In one embodiment, the bet may be one overall bet for all hands, the bet may be applied to each of the poker hands selected to be played, the bet may be an automated bet based on predefined values, and/or there may be no bet at all for the game when the game is a free game or play for fun game.

Step 502 deals the first hand face up. For display purposes only, the remaining hands selected to be played are displayed as card backs and are only place holders for where the additional poker hands will be dealt in the step 505.

Step 503 receives selections from a layer for holding cards for first hand.

Step 504 leaves hold cards and replaces draw cards for first hand.

Step 505 deals poker hands 2 through N, or the remaining hands to be played as selected by the player, to the player and displays the hands face up replacing the place holder card backs that were previously displayed.

Step 506 calculates the use of one or more of the hold cards for poker hands 2 through N to make each of the additional poker hands better. As described above in one embodiment, if the use of one or more of the hold cards does not make a particular poker hand better in the additional poker hands, one or more of the hold cards will not be used for that particular poker hand.

Step 507 automatically replaces cards in hands 2 though N with hold cards from first hand only if hold cards make a particular poker hand 2 through N payout higher based on the particular pay table used by the game.

Step 508 calculates the player's overall win based on the game pay table used for each poker hand from 1 to N.

Step 509 pays the player based on the calculated win amount from step 508. In other embodiments where the game is a play for fun game the payout may include no payout or may include an award other than money or credits, such as for example including but not limited to merchandise, comps, promotional awards, promotional credits, free play.

Step 510 ends the game, which in one embodiment may terminated the game or the game may automatically play again. In another embodiment, when the game is played as a secondary game or bonus game, the game may return to a base game.

Figure 6:
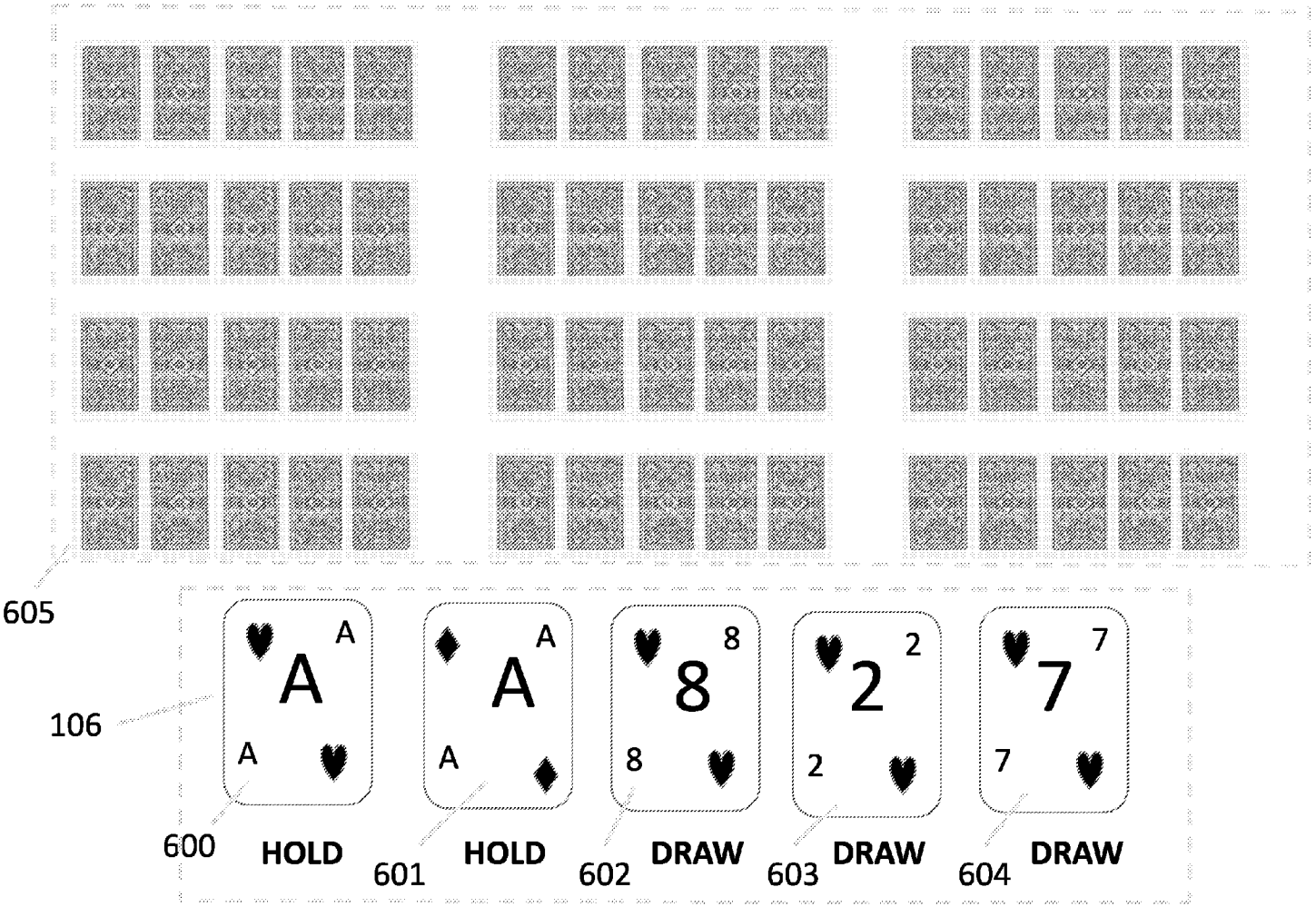
FIG. 6 illustrates an additional embodiment wherein first hand is displayed face up wherein the player selects hold cards while card backs are also displayed as place holders for the additional hands.
Figure 7:
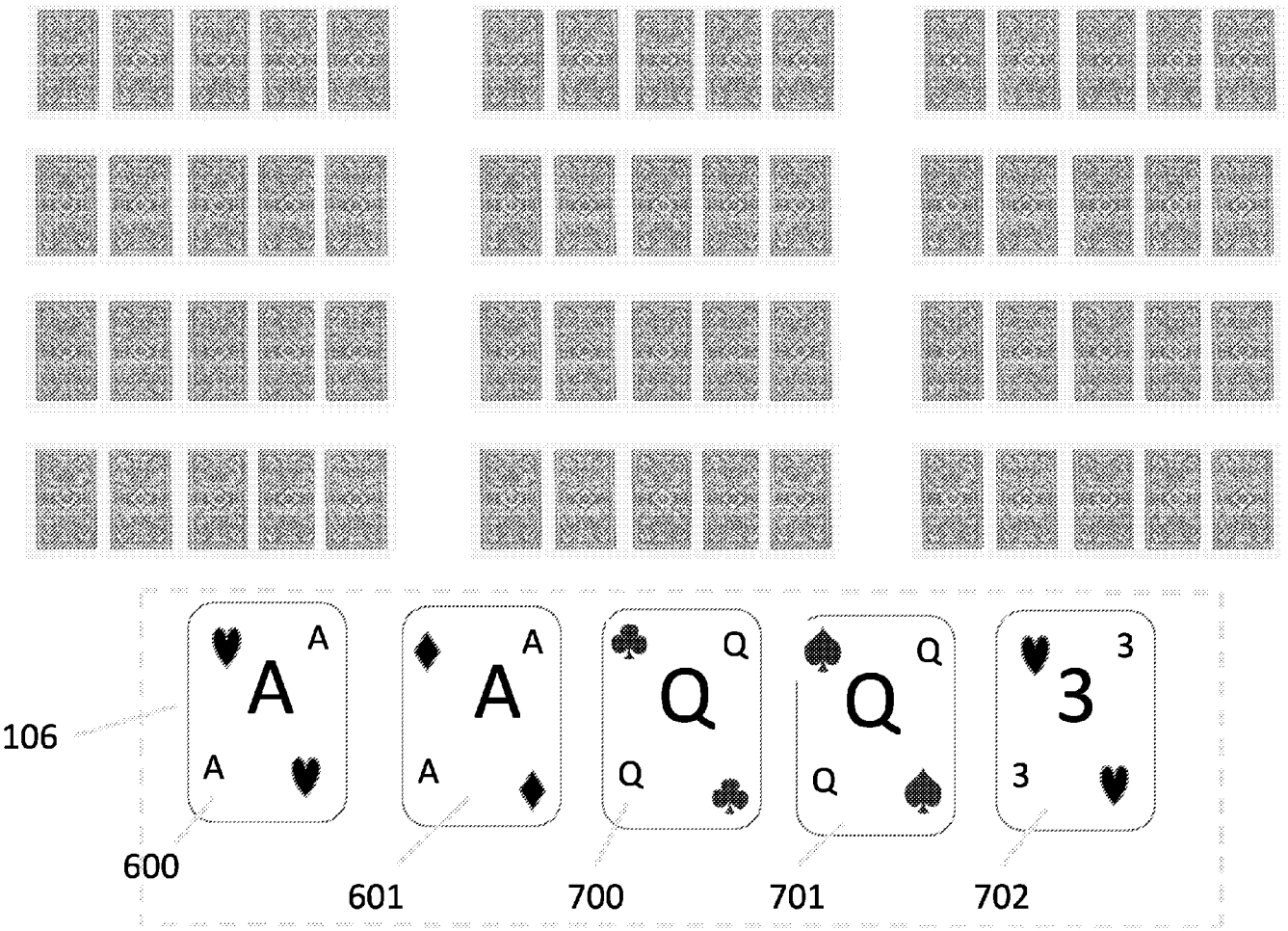
FIG. 7 illustrates the draw for the first hand for the additional embodiment wherein hold cards remain and draw cards are replaced.
Figure 8:
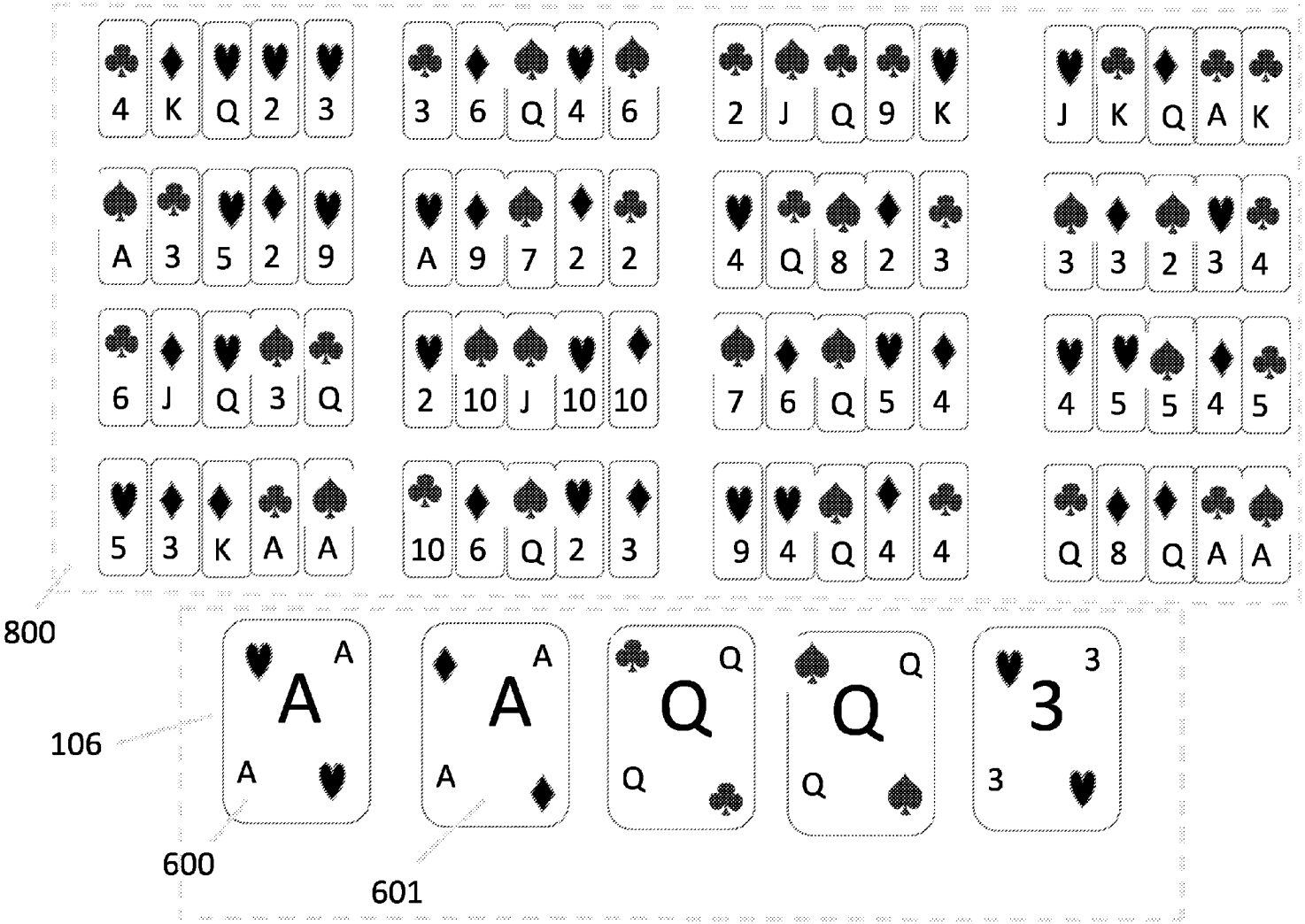
FIG. 8 illustrates additional hands displayed after being dealt to the player.
Figure 9:
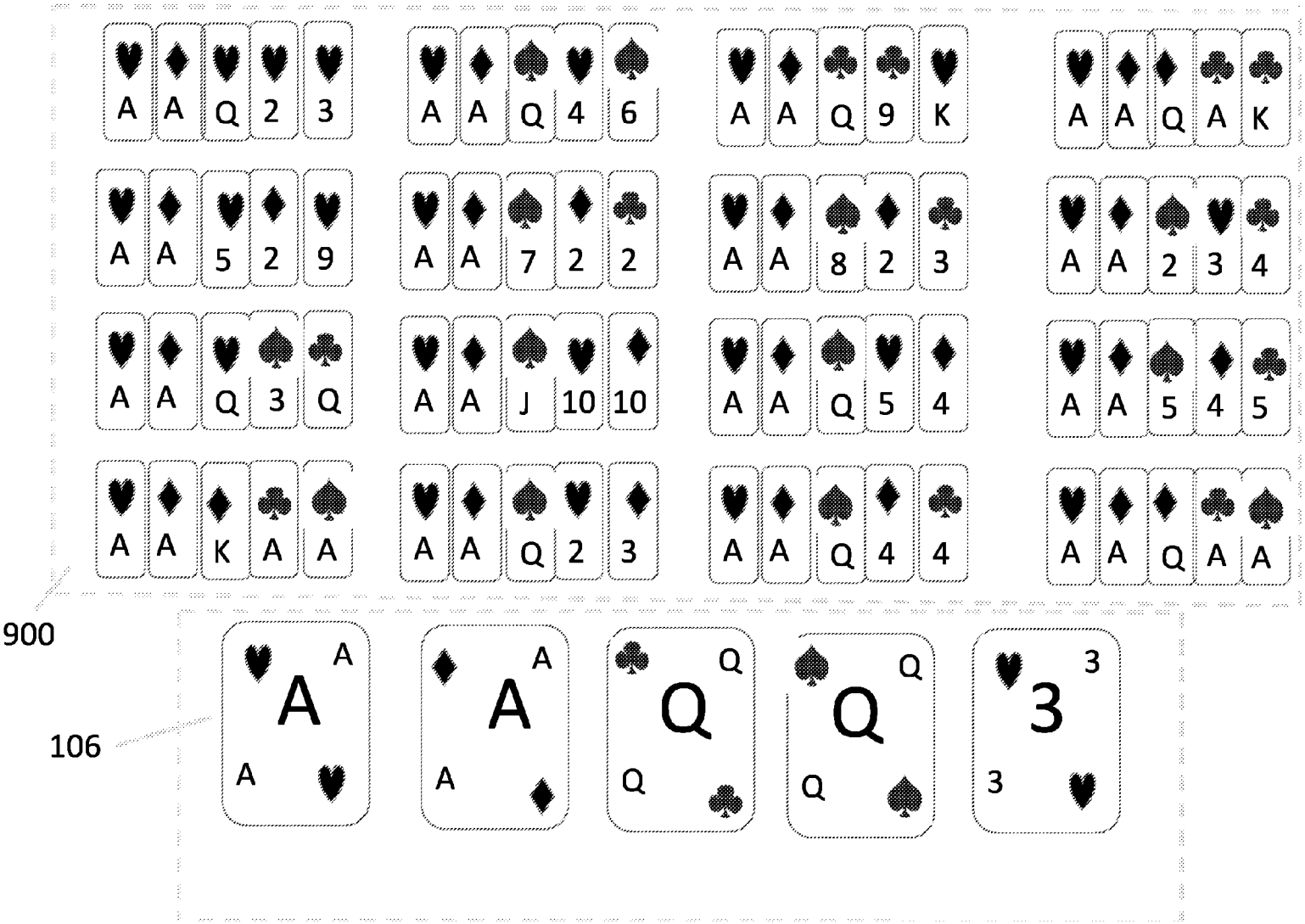
FIG. 9 illustrates the additional embodiment wherein the use of hold cards for the first hand replaces cards in each of the additional hands based on the position of the hold cards from the first hand.

In one embodiment, FIG. 6, FIG. 7 and FIG. 8 illustrate the play of the game as described above, however in this particular embodiment, FIG. 9 illustrates the one or more cards, card 600 and card 601 selected to be held in the first hand 106 are duplicated into the additional poker hands 900, whether the cards make a better poker hand or not.

In the embodiment illustrated in FIG. 9, the cards 600 and 601 are duplicated into the same positions as dealt in the first hand 106 for each particular poker hand in the additional poker hands 900. This may result in a player receiving a worse hand than what was dealt to the player. For example, the player had received a full house in the $16^{th}$ hand, but the two aces replaced the first two cards.

Figure 10:
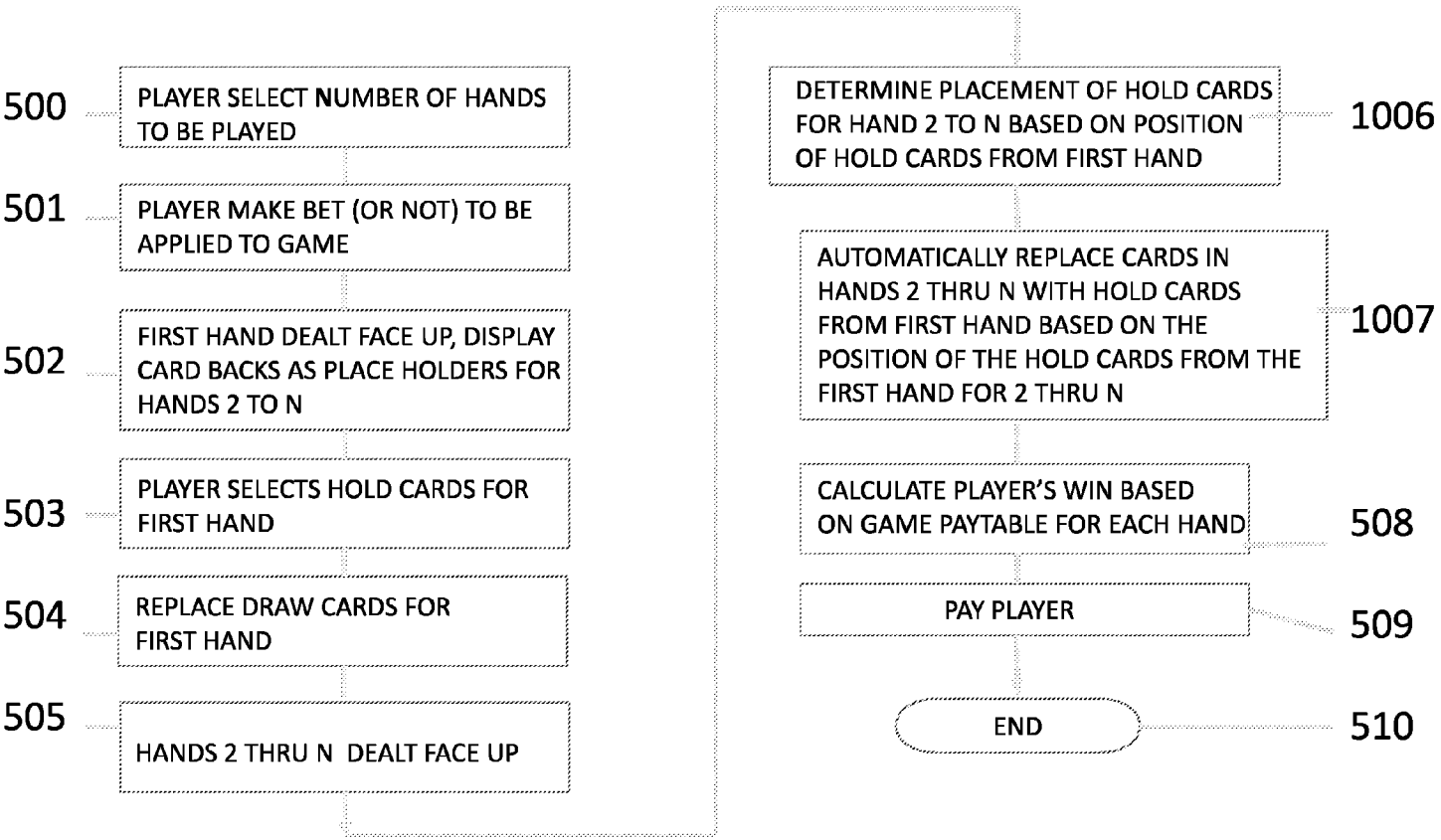
FIG. 10 is a flow chart of the additional embodiment of the game.

When the player decides not to hold any cards dealt from the first poker hand 106, "none" of the cards that are dealt to the player for the first hand 106 may be used for the additional poker hands 900 and the player only receives a pay out from any winning outcome on the deal of the additional poker hands 900 according to the pay table used for the particular embodiment of the game Now turning to FIG. 10, in this embodiment the method for replacing cards within the additional poker hands in steps 1006 and 1007 uses the first hand hold card placement to determine the location in which to replace cards for each of the additional poker hands.

Payouts to the player may be based on the player's bet and the calculated win amount. In other embodiments where the game is a play for fun game the payout may include no payout or may include an award other than money or credits, such as for example including but not limited to merchandise, comps, promotional awards, promotional credits, free play.

Upon game completion or when the game is terminated, the game may automatically play again. In other embodiments when the game is played as a secondary game, promotional game or bonus game, the game may return to a base game.

In other embodiments, the game may be played concurrent with one or more other games or base games and may be displayed on one layer of a multiple layer game display while another game is played on a different layer of game display. In embodiments where multiple layer game displays are used, the player may view all games displayed on each layer simultaneously, each game selectively or the games may be displayed based on an externally defined game configuration.

The player is paid for any winning hands based on the player's wager and at least one predefined pay tables according to the rules defined for the particular card game being played.

An example pay table is set forth in Table 1. However, any representative pay table may be used by the game. In a preferred embodiment at least two pay tables are used, one for the first poker hand and one for the additional poker hands.

Table 1 shows a suitable pay table that is used by the game when playing a basic jacks or better poker format for the first hand.

In one embodiment, the game play utilizes a separate standard 52 deck of cards for each poker hand played. Additionally any number of WILD cards may be designated in each of the decks of cards used by the game and additional WILD cards may be added to the deck for some versions of the game.

In one embodiment, all cards from the first hand are removed from each of the 2 through N decks of cards used to deal poker hands 2 through N thus preventing the player from being dealt the same card as any one of the cards dealt in the first hand. Once the cards from the first hand are removed from each of the 2 through N decks of cards and after first hand 106 draw cards have been dealt to the player, the player is only then dealt cards to form poker hands 2 through N.

In a further example of this embodiment, the player selects the desired hold cards by pressing a button or touching the game screen 20 (FIG. 17) on an electronic video poker game 10 to hold cards for a 5 card poker game for the first hand, such as, for example, as illustrated in FIGS. 1 and 17, first hand 106 is dealt an ACE of HEARTS 100, ACE of DIAMONDS 101, SEVEN of HEARTS 102, EIGHT of HEARTS 103 and FIVE of HEARTS 104 from a 52 card deck #1. In this example, the player decides to hold the ACE of HEARTS 100 and the ACE of DIAMONDS 101. These two cards are now known as the hold cards.

Turning to FIG. 2, the hold cards ACE of HEARTS 100 and ACE of DIAMONDS 101 remain while the remaining cards of first hand 106 are replaced with draw cards 200, 201 and 202. Next for each of the remaining poker hands 2 through N a separate standard 52 card deck is used. In each of these 52 card decks 2 through N, the ACE of HEARTS 100, ACE of DIAMONDS 101, SEVEN of HEARTS 102, EIGHT of HEARTS 103 and FIVE of HEARTS 104 are removed leaving 47 cards in each of the 2 through N decks to be used to deal each of the poker hands 2 through N. For example, Deck #2 deals cards to poker hand #2, deck #3 deals cards to poker hand #3, deck #4 deals cards to poker hand #4 and so on.

In one embodiment of the example, after each of the 5 card poker hands 2 through N have been dealt to the player and displayed face up, the ACE of HEARTS and the ACE of DIAMONDS hold cards are now used to automatically and without player interaction replace one, two, or none of the cards that were dealt for each poker hand 2 through N to form the best poker hand possible as defined by the pay table used for the game being played. In this manner, unlike the prior art, the present invention can increase the hit frequency and increased payouts for the additional games as the hold cards are first evaluated before being applied to form the best poker hand for the additional hands. Efficiency is further increased as hold cards evaluated to make the additional hands better can now be applied at once to all of the additional poker hands.

In other embodiments, any number of decks may be used for each poker hand such as, for example one or more decks may be used for each particular poker hand being played. In still other embodiments, a single deck may be used for a group of poker hands, such as one deck for each 5 poker hands being played. In this way, multiple player versions of the game are envisioned wherein a specific player is associated with a particular poker hand.

In one embodiment, the player makes a wager such as, for example, 2 coins that are then applied to each of the 1 through N poker hands as separate wagers. For example, if 17 hands are played by the player for a particular game, each of the 17 hands use a separate 2 coin bet wherein a total of 2 coins times 17 hands or 34 coins in total are wagered by the player for the game. In this example, each of the bets are applied to a particular poker hand 1 through 17 and the pay out for each of the poker hands 1 through 17 would be according to the poker hand dealt, the wager and the particular pay table used such as illustrated in Table 1.

In other embodiments, a single wager may be made by the player that is applied to each poker hand being played by dividing the total wager by the total amount of poker hands being played, such as, when the player is playing 17 poker hands and the player wagers 17 coins for the game. In this particular example, a wager of 1 coin is applied to each of the 17 poker hands being played and the payout for each of the hands 1 through 17 would be according to the poker hand dealt, the 1 coin wager and the particular pay table used.

In one embodiment, a game configuration parameter may be set, for example, as TRUE by the gaming establishment or vendor prior to game play in order for the game to always use the hold cards of the first hand for the one or more additional hands during game play irrespective of how it affects the game results for the one or more additional hands. Conversely, the game configuration parameter may be set, for example, as FALSE by the gaming establishment or vendor prior to game play in order for the game to only use the hold cards of the first hand for the one or more additional hands if the use of said first hand hold cards causes each of the one or more additional hands to be a better poker hand based on the rules of the particular card game being played.

In one or more embodiments, all the cards dealt for the first hand (e.g., held and/or non-held cards) are removed from each of the decks of cards used for the one or more additional poker hands being played by the player.

In one embodiment, FIG. 11, FIG. 12, FIG. 13, and FIG. 14 illustrate the play of the game as described earlier. In this particular embodiment, FIG. 11 illustrates the cards not held 1102, 1103 and 1104 which will be discarded by the player and new cards will be dealt for the first hand. Cards—ACES OF HEARTS 600, ACE OF DIAMONDS 601, EIGHT OF HEARTS 1102, TWO OF HEARTS 1103 and SEVEN OF HEARTS 1104 are removed from each of the card decks used to deal hands 2 through N or also referred to as one or more additional hands after the first hand draw cards have been dealt and prior to the deal of hands 2 through N (one or more additional hands).

Now turning to the example illustrated in FIG. 13, after the cards ACES OF HEARTS 600, ACE OF DIAMONDS 601, EIGHT OF HEARTS, TWO OF HEARTS and SEVEN OF HEARTS are removed from each of the card decks used for the one or more additional hands dealt, the one or more additional hands 800 in FIG. 13 and in FIG. 14, the one or more additional hands 900 are played as described earlier. While the described example illustrates how the discarded cards from the first hands are removed from decks of cards used for the one or more additional hands illustrated in FIG. 13 and FIG. 14, it should be understood that removing the cards from the first hand as described may be included as a step in any described embodiment. For example, turning to FIG. 15, an additional step 1500 has been included wherein the ALL cards from the first hand to draw new cards are removed from the decks of cards used for hands 2 thru N.

It should also be understood that while the described example removes the cards associated with the first hand from all the card decks used to deal the one or more additional hands, other embodiments are also included in the invention; including but not limited to, removing only the new cards drawn for the first hand, removing both the discarded cards and the draw cards dealt for the first hand or any combination of cards associated with such and removing specifically identified cards from all the decks of cards used for the one or more additional hands.

In a further embodiment, turning to FIG. 16, an additional step has been included in step 1007. Along with step 1006 wherein the placement of the hold cards for hand 2 thru N are based on the position of the hold cards from the first hand (e.g., the hold card in the first hand are placed in the same position in 2 thru N hands). The one or more cards held in the first hand are only used in hands 2 thru N by placing them in the same card positions as they were held in the first hand, only if they improve one or more of the 2 thru N hands (e.g., make the hand a higher payout) by using one or more of the held card duplicated from the first hand into one or more of the 2 thru N hands.

The method of the present invention may also be used in a multi-game spinning reel game where indicia, (e.g., symbols, cards, numbers, letters, etc) may be used to create winning combination for at least one pay table. Game play would be very similar to the method described above. Player would be able to play a first game and the player would be able to hold one or more indicia from a first game to be used in a 2 thru N games.

The method of the present invention may also be used in a multi-game spinning reel game where indicia such as symbols, cards, numbers, letters, etc. may be used to create winning a combination for at least one pay table. Game play would be very similar to the method described above. A player would be able to play a first game and the player would be able to hold one or more indicia from a first game to be used in a 2 thru N games. For example, the player would be able to play at least two games.

In this embodiment both games would be the same i.e., three reel one line with 30 indicia which would be the numbers 1 thru 10 three times.

| Game one | | | Game two | | |
|---|---|---|---|---|---|
| Reel 1 | Reel 2 | Reel 3 | Reel 1 | Reel 2 | Reel 3 |

The player places a wager of 5 credits each on game 1 and 2 and initiates game play. In this embodiment Game one would play and game two would be idle.

Example:

| Game one | | | Game two | | |
|---|---|---|---|---|---|
| R1 = 5 | R2 = 5 | R3 = 7 | Reel 1 | Reel 2 | Reel 3 |

The player receives a 5 in reel position 1, 5 in reel position 2 and a 7 in reel position 3. At this time the player may be paid for any winning combination the player received based on a pay table for game one. The player now gets to choose to hold none, one or more indicia in game one. The player holds the 5 in reel position one and the 5 in reel position two. Then the player initiates game play for games one and two. In game one, new indicia are generated for all the reel positions not held and in game two new indicia are generated for all the reel positions.

Example:

| Game one | | | Game two | | |
|---|---|---|---|---|---|
| R1 = 5 | R2 = 5 | R3 = 9 | R1 = 8 | R2 = 8 | R3 = 5 |

At this time the computer controller of the gaming device determines if the one or more indicia that were held in game one can be used to improve the outcome of the indicia of game two. If the indicia held in game one can improve the outcome of game two by replacing the indicia in game two with one or more of the indicia from game one, then the indicia are used. If they cannot they are not used. In an embodiment the indicia's from game one are only used to improve the outcome of games 2 thru N by replacing the indicia of 2 thru N games from the same positions as they were held in game one. In this embodiment the indicia from reels one and two of game one are used in game two.

Example:

| Game one | | | Game two | | |
|---|---|---|---|---|---|
| R1 = 5 | R2 = 5 | R3 = 7 | R1 = 5 replaced | R2 = 5 replaced | R3 = 5 |

The player is paid for receiving three fives in game two based on a pay table associated with game two.

Now turning to FIG. 17, an electronic video poker machine 10 for use with the present invention is shown. The electronic video poker machine 10 comprises a game screen 20 on which a plurality of poker hands such as the first hand 106 can be displayed. Wagers can be accepted by slot 50 and the desired number of hands can be wagered by selecting number of hands button 80.

Console deal/draw button 46 or deal/draw button 47 on game screen 20 can be used to deal and/or draw as necessary. Particular embodiments have been presented as an electronic video poker game that in one embodiment may be played on a traditional gaming device used for casino gaming with physical buttons or touch screen technology to make game selections such as, for example but not limited to hold, draw, bet, and number of hands.

In another embodiment, the game may be played on a PC computer such as a lap top or desk top computer. In another embodiment, the game may be played on a hand held gaming device with button or touch panel game controls such as, for example but not limited to hold, draw, bet, and number of hands.

In another embodiment, the game may be played on a network computer wherein the game resides on a remote server computer while the game controls are activated by interacting with a keyboard, mouse or touch screen on the network computer. In another embodiment, the game may be played as a live electronic table game by a single player game or a multiple players with or without a dealer using physical cards or electronic cards with one or more displays associated with one or more player positions.

Although the description has been described with respect to particular embodiments thereof, these particular embodiments are merely illustrative, and not restrictive. Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium or tangible medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nano-engineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

I claim:

1. A method of playing multiple hands of video poker, the method comprising:

dealing a first poker hand with three or more cards face up before a second poker hand having two or more cards face up is dealt;

selecting based on a user's input, a hold card from the first poker hand;

drawing one or more cards to replace non-held cards of the first poker hand to complete the first poker hand;

evaluating whether using the hold card in the second poker hand will result in a higher hand for the second poker hand, wherein said evaluating is by using the hold card to replace any one of the initial cards of the second poker hand and then obtaining a ranking of the second poker hand, wherein the initial card that is replaced can be in any position that will result in the highest hand for the second poker hand;

if using the hold card in the second poker hand will not result in a higher hand for the second poker hand, retaining the initial cards of the second poker hand, said initial cards being face up and determining a ranking of the second poker hand with the initial cards that are face up and determining a ranking of the first poker hand; and if using the hold card in the second poker hand will result in a higher hand, duplicating the hold card into a duplicate hold card to replace any one of the initial cards that is face up in the second poker hand, wherein the initial card that is replaced is in any position that results in the highest hand for the second poker hand, said hold card being retained in the first poker hand, and determining a resulting ranking of said higher hand of the second poker hand that includes the duplicate hold card replacing one of the initial cards that is face up as well as determining a ranking for the first poker hand.

2. The method of claim 1 wherein said evaluating whether using the hold card further comprises:

using a pay table to obtain a ranking of the second poker hand without said duplicate hold card;

using said pay table to obtain a ranking with said duplicate hold card replacing a card of the second poker hand; and comparing the ranking without said duplicate hold card and the ranking with said duplicate hold card to determine which ranking is higher.

3. The method of claim 1 wherein said evaluating whether using the hold card in the second hand is based on a standard ranking of poker hands that is determined before said multiple hands of video poker is initiated.

4. The method of claim 1 wherein the second poker hand is dealt from a standard 52-card deck wherein all cards dealt in the first poker hand are removed there from.

5. A method of playing video poker, said method comprising:

dealing a first poker hand with three or more cards face up and a second poker hand having three or more cards face up;

receiving a user-input signal to select a hold card from a first poker hand;

evaluating if said hold card can enhance the second poker hand to provide a higher hand;

if said the hold card cannot enhance the second poker hand and will not result in a higher hand for the second poker hand, retaining initial cards of the second poker hand, and determining a ranking of the second poker hand with the initial cards that are face up as well as determining a ranking of the first poker hand; and if said hold card can enhance the second poker hand to provide a higher hand, using said hold card from said first poker hand to replace a card selected from the second poker hand and subsequent poker hands thereof.

6. The method of claim 5 wherein said hold card is evaluated by using a pay table designated for the second poker hand.

7. The method of claim 5 wherein said hold card is evaluated by determining a ranking of the second poker hand without said hold card;

determining a ranking of the second poker hand with said hold card; and comparing the ranking without said hold card and the ranking with said hold card to determine which ranking is higher.

8. The method of claim 5 further comprising designating a first pay table to the first poker hand.

9. The method of claim 5 further comprising designating a second pay table, different from a first pay table, to the second poker hand.

10. The method of claim 5 further comprising receiving a first wager for the first poker hand.

11. The method of claim 5 further comprising receiving a second separate wager for the second poker hand.

12. The method of claim 5 wherein the second poker hand is dealt from a standard 52-card deck.

13. The method of claim 12 wherein the hold card is removed from the standard 52-card deck before the second poker hand is dealt.

14. The method of claim 12 wherein all cards dealt to the first poker hand are removed from the standard 52-card deck before the second poker hand is dealt.

15. The method of claim 5 wherein all cards dealt in the first poker hand are removed from a 52-card deck before the second poker hand is dealt there from.

16. The method of claim 5 further comprising receiving a single wager for both the first poker hand and the second poker hand.

17. A video poker machine having a display device, an input device and a computer processor, said video poker machine comprising:

a display device;

an input device; and a computer processor configured with the display device and the input device to:

(a) display a first hand having at least three cards before a second hand having at least three cards is dealt;

(b) receive a user input signal to select one or more hold cards from the at least three cards of the first hand;

(c) receive a user input signal to display the second hand having at least three cards;

(e) select one or more cards in the second hand for replacement with one or more of the hold cards from the first hand;

replacing the selected one or more cards with the one or more hold cards if a higher poker hand results for the second poker hand by using the one or more hold cards; and (f) if using the hold card in the second poker hand will not result in a higher hand for the second poker hand, retaining initial cards of the second poker hand, said initial cards being face up and determining a ranking of the second poker hand with the initial cards that are face up as well as a ranking of the first poker hand.

18. The video poker machine of claim 17 wherein the computer processor is configured such that:

if using the hold card in the second poker hand will result in a higher hand, duplicating the hold card into a duplicate hold card to replace any one of the initial cards that is face up in the second poker hand, wherein the initial card that is replaced is in any position that results in the highest hand for the second poker hand, said hold card being retained in the first poker hand, and determining a resulting ranking of said higher hand of the second poker hand that includes the duplicate hold card replacing one of the initial cards that is face up as well as determining a ranking for the first poker hand and displaying the second hand after receiving a user-input signal to deal the second hand.

19. The video poker machine of claim 17 wherein the computer processor is configured to:

deal the second hand from a 52-card deck from which all cards dealt in the first hand are removed.

* * * * *